United States Patent [19]

Kokubo et al.

[11] Patent Number: 4,726,522

[45] Date of Patent: Feb. 23, 1988

[54] VIBRATING ELEMENT FOR ULTRASONIC ATOMIZATION HAVING CURVED MULTI-STEPPED EDGED PORTION

[75] Inventors: Kakuro Kokubo, Kanagawa; Masami Endo; Daijiro Hosogai, both of Saitama, all of Japan

[73] Assignee: Toa Nenryo Kogyo Kabushiki Kaisha, Tokyo, Japan

[21] Appl. No.: 861,474

[22] Filed: May 9, 1986

[30] Foreign Application Priority Data

May 13, 1985 [JP] Japan ..... 60-100936

[51] Int. Cl.[4] ..... B05B 17/06; F02M 61/04; F23D 11/34

[52] U.S. Cl. ..... 239/102.2; 239/500

[58] Field of Search ..... 239/102.1, 101, 102.2, 239/4, 533.12, 500, 501, 380; 261/DIG. 48

[56] References Cited

U.S. PATENT DOCUMENTS

| | | | |
|---|---|---|---|
| 578,461 | 3/1897 | Mertz | 239/498 |
| 1,659,538 | 2/1928 | Angrove . | |
| 1,730,664 | 10/1929 | Kruse | 239/590.5 |
| 1,758,119 | 5/1930 | Le Moon | 239/460 |
| 2,596,341 | 5/1952 | McCreery et al. | 239/590.5 |
| 2,712,962 | 7/1955 | Goddard | 239/500 X |
| 3,110,444 | 11/1963 | Eakins | 239/500 |
| 3,317,139 | 5/1967 | Freeland | 447/634 |
| 3,373,752 | 3/1968 | Inoue | 239/4 |
| 3,749,318 | 7/1973 | Cottell | 239/102 |
| 3,756,575 | 9/1973 | Cottell | 239/102.2 X |
| 4,197,997 | 4/1980 | Wu et al. | 239/102 |
| 4,350,302 | 9/1982 | Gruber et al. | 239/500 |
| 4,372,491 | 2/1983 | Fishgal | 239/102 |
| 4,403,741 | 9/1983 | Moriya et al. | 239/585 |
| 4,408,722 | 10/1983 | Frelund | 239/533.12 X |
| 4,474,326 | 10/1984 | Takahashi | 239/102 |
| 4,496,101 | 1/1985 | Northman | 239/102 |
| 4,501,406 | 2/1985 | Walther et al. | 251/30 |
| 4,541,564 | 9/1985 | Berger et al. | 239/102 |

FOREIGN PATENT DOCUMENTS

| | | |
|---|---|---|
| 0159189 | 10/1985 | European Pat. Off. . |
| 861344 | 7/1949 | Fed. Rep. of Germany . |
| 2239408 | 2/1974 | Fed. Rep. of Germany . |
| 786492 | 9/1935 | France . |
| 197801 | 1/1978 | U.S.S.R. . |

*Primary Examiner*—Andres Kashnikow

*Attorney, Agent, or Firm*—Seidel, Gonda, Goldhammer & Abbott

[57] ABSTRACT

The present invention consists of a vibrating element for ultrasonic atomization formed around its inner or outer periphery with a multi-stepped edged portion having at least two steps, each edged portion defining an edge, the edged portions being supplied with liquid for atomization, wherein the multi-stepped edged portion includes successively connected continuous curved surfaces where the steps are partially formed with a curved surface.

6 Claims, 8 Drawing Figures

VIBRATING ELEMENT FOR ULTRASONIC ATOMIZATION HAVING CURVED MULTI-STEPPED EDGED PORTION

TECHNICAL FIELD

This invention relates generally to an ultrasonic atomizer or an ultrasonic injection nozzle, and particularly to a vibrating element for use with an ultrasonic injection nozzle for atomizing liquid intermittently or continuously. Such vibrating element may be effectively used with (1) automobile fuel injection valves such as electronically controlled gasoline injection valves and electronically controlled diesel injection valves, (2) gas turbine fuel nozzles, (3) burners for use on industrial, commercial and domestic boilers, heating furnaces and stoves, (4) industrial liquid atomizers such as drying atomizers for drying liquid materials such as foods, medicines, agricultural chemicals, fertilizers and the like, spray heads for controlling temperature and humidity, atomizers for calcining powders (pelletizing ceramics), spray coaters and reaction promoting devices, and (5) liquid atomizer for uses other than industrial ones, such as spreaders for agricultural chemicals and antiseptic solution.

BACKGROUND ART

Pressure atomizing burners or liquid spray heads have been heretofore used to atomize liquid in the various fields of art as mentioned above. The term "liquid" herein used is intended to mean not only liquid but also various liquid materials such as solution, suspension and the like. Injection nozzles used on such spray burners and liquid atomizers are adapted to atomize the liquid by virtue of the shearing action between the liquid discharged through the nozzles and the ambient air (atmospheric air). Accordingly, increased pressure under which the liquid was supplied was required to achieve atomization of the liquid, resulting in requiring complicated and large-sized liquid supplying facility such as pumps, piping and the like.

Furthermore, regulation of the flow rate of injection was effected by varying either the pressure under which to deliver supply liquid or the area of the nozzle outlet opening. However, the former method provided poor liquid atomization at a low flow rate (under a low pressure), as a remedy for which air or steam was additionally used on medium or large-sized boilers to aid in atomization of liquid, requiring more and more complicated and enlarged apparatus. On the other hand, the latter method required an extremely intricate construction of nozzle which was troublesome to control and maintain.

In order to overcome the drawbacks to such prior art injection nozzles, attempts have been made to impart ultrasonic waves to liquid material as it is injected out through the jet of the injection nozzle under pressure.

However, the conventional ultrasonic liquid injecting nozzle had so small capacity for spraying that it was unsuitable for use as such injection nozzle as described above which required a large amount of atomized liquid.

As a result of extensive researches and experiments conducted on the ultrasonic liquid atomizing mechanism and the configuration of the ultrasonic vibrating element in an attempt to accomplish atomization of a large amount of liquid, the present inventors have discovered that it is possible to atomize a large quantity of liquid by providing an ultrasonic vibrating element formed at its end with an edged portion along which liquid may be delivered in a film form, and have proposed an ultrasonic injection nozzle based on said concept as disclosed in Japanese Patent Application No. 59-77572.

The present inventors have discovered through further studies and experiments on the configuration of the vibrating element for such ultrasonic injection nozzle that the configuration of the vibrating element has a great effect on the amount of liquid being atomized and the liquid "drainability" of the element during a short cycle injection as required when used with diesel injection valves, for example.

The present invention is based on such novel knowledge and relates to improvements on the ultrasonic injection nozzle of the type according to the invention of the aforesaid earlier patent application, and particularly to improvements on the vibrating element for use with such ultrasonic injection nozzle or ultrasonic atomizing apparatus, and is characterized by the configuration of the vibrating element.

SUMMARY OF THE INVENTION

It is an object of this invention to provide a vibrating element for use with an ultrasonic injection nozzle which is capable of delivering liquid intermittently or continuously.

It is another object of the invention to provide a vibrating element for an ultrasonic injection nozzle which is capable of delivering and atomizing or spraying a large quantity of liquid as compared with the conventional injection nozzle and ultrasonic injection nozzle.

It is still another object of the invention to provide a vibrating element for ultrasonic atomization which is able to eliminate liquid stagnation and improving the drainability or cutting-off of spray as required in a diesel injection valve or the like.

It is yet another object of the invention to provide a vibrating element for ultrasonic atomization which is capable of accomplishing consistent atomization in that there is no change in the conditions of atomization (flow rate and particle size) depending upon the properties, particularly the viscosity of the supply liquid.

The aforesaid objects may be accomplished by the vibrating element for ultrasonic atomization according to the present invention.

Briefly, the present invention consists in a vibrating element for ultrasonic atomization formed around its outer or inner periphery with a multi-stepped edged portion having one or more steps each defining an edge, said edged portion being supplied with liquid for atomization, wherein said multi-stepped edged portion comprises successively connected continuous curved surfaces or said step or steps are partly formed with a curved surface.

Specific embodiments of the present invention will now be described by way of example and not by way of limitation with reference to the accompanying drawings.

DESCRIPTION OF THE EMBODIMENTS

First, a typical example of the prior art ultrasonic injection nozzle with which a vibrating element according to this invention may be used will be described with reference to FIG. 7.

While the present invention may be suitably used for nozzles of various applications as indicated herein above, it will be described with reference to an electronically controlled diesel engine injection valve.

Figure 7:
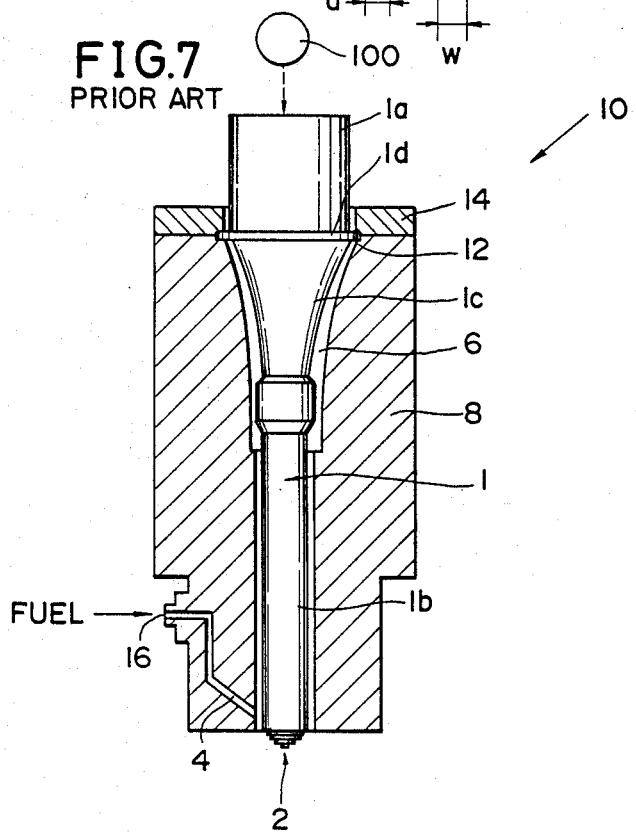
FIG.7 PRIOR ART
FIG. 7 is a schematic cross-sectional view illustrating an ultrasonic injection nozzle equipped with a prior art vibrating element which may be replaced by an ultrasonic atomizing vibratory element according to the present invention.

Referring to FIG. 7, an injection nozzle which is a diesel engine injection valve 10 in the illustrated example includes a generally cylindrical elongated valve body 8 having a central bore 6 extending through the center thereof. Disposed extending through the central bore 6 is a vibrating element 1 which includes an upper body portion 1*a*, an elongated cylindrical vibrator shank 1*b* having a diameter smaller than that of the body portion 1*a*, and a transition portion 1*c* connecting the body portion 1*a* and the shank 1*b*. The body portion 1*a* has an enlarged diameter flange 1*d* which is attached to the valve body 8 by a shoulder 12 formed in the upper end of the valve body and an annular vibrator retainer 14 fastened to the upper end face of the valve body by bolts (not shown).

Figure 6:
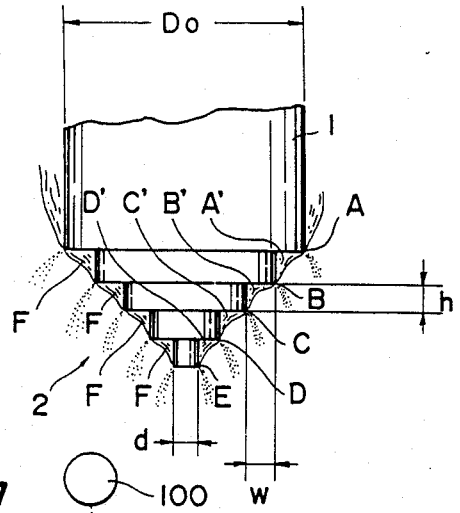
FIG.6 PRIOR ART
FIG. 6 is a fragmentary front view of the edged portion of a prior art vibrating element.

The forward end of the vibrating element 1, that is, the forward end of the shank 1*b* is formed with an edged portion 2 the details of which are shown in FIG. 6. The valve body 8 is formed through its lower portion with one or more supply passages 4 for feeding said edged portion 2 with fuel. The fuel inlet part 16 of the supply passage 4 is fed with liquid fuel through an exterior supply line (not shown) from an external source of fuel (not shown). The flow and flow rate of fuel are controlled by a supply valve (not shown) disposed in the exterior supply line.

With the construction described above, the vibrating element 1 is continuously vibrated by an ultrasonic generator 100 operatively connected to the body portion 1*a*. Liquid fuel is thus supplied through the exterior line, the supply valve and the supply passage 4 to the edged portion 2 where the fuel is atomized and discharged out.

As illustrated in FIG. 6, the edged portion 2 of the prior art vibrating element 1 comprises a plurality of (five in FIG. 6) annular steps having progressively reduced diameters.

More specifically, with the construction described above, as liquid which is fuel in the illustrated example is passed to the edged portion 2, the stream of fuel is severed and atomized at each edge due to the vertical vibrations imparted to the vibrating element 1. Fuel is first partially atomized at the edge A of the first step, and the excess portion of the fuel which has not been handled at the first step edge A is fed further through the second step edge B, third step edge C and so on to be handled thereby. It is to be understood that at a higher flow rate of fuel a larger effective area is required for atomization, requiring a greater number of step edges. At a lower flow rate, however, a smaller number of steps are required before the atomization of fuel is completed. With the vibrating element 1 as described above, the number of steps required will vary with changes in the flow rate so as to insure generally uniform conditions such as the thickness of liquid film at the location of each step where the atomization takes place, resulting in uniform particle size of the droplets being atomized. In addition, the vibrating element of this type accommodates a full range of flow rates usually required for atomization, so that pulverization of various types of liquid material may be accomplished, whether it may be on an intermittent basis or a continuous basis.

The geometry of the edged portion of the vibrating element 1 such as the shape, height (h) and width of each step of the edged portion of the vibrating element as shown in FIG. 6 was such that the edge of each step might act to reduce the liquid to a thin film and dam the liquid flow.

However, with the vibrating element 1 having such configuration, the successive edges A, B, C, D, and E are separated from each other so that recesses A', B', C' and D' are defined between each adjacent edges in which recesses liquid or fuel F is held as a pool. Even though the vibrating element 1 is vibrating, it cannot finish injecting the fuel F held in the recesses A'-D' for atomization within one short lime cycle of the engine operation (compression, expansion, exhaustion and suction processes), resulting in decreasing the time available for combustion of the fuel droplets after injected until the exhaustion process starts, so that soot tends to be produced due to incomplete combustion. After the vibrating element 1 is stopped, some of the fuel is retained as a pool at the tip of the element while remaining unatomized and will fall off the tip in droplets into the engine cylinder in process of time. Thus, a phenomenon which is called "poor spray drainability" occurs. This phenomenon should be avoided by all means in a diesel engine injection valve or the like.

The present inventors have discovered that such phenomenon may be eliminated by interconnecting the edges A, B, C, D and E by continuous curved surfaces to thereby remove the recesses A', B', C' and D' where fuel F may be held as a pool.

Figure 1:
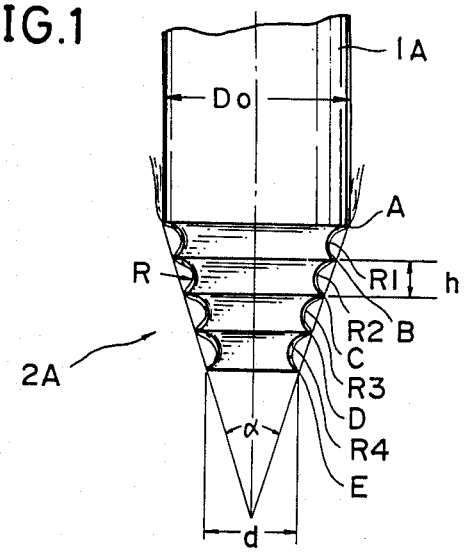
FIGS. 1 to 3 are fragmentary front views of various embodiments of the ultrasonic atomizing vibratory element according to the present invention.

Referring now to FIG. 1, an embodiment of the ultrasonic vibrating element according to this invention is illustrated. The vibrating element 1A is similar to the prior art vibrating element 1 shown in FIG. 6 in that it has an edged portion 2A comprising a plurality of (five in the embodiment of FIG. 1) annular steps, but is significantly distinguished in that the edges A, B, C, D and E are connected together by continuous curved lines (continuous curved surfaces) R1, R2, R3 and R4.

The continuous curved lines (continuous curved surfaces) R1, R2, R3 and R4 may have the same radius of curvature or different radii from each other. The number of steps formed in the edged portion 2A is not limited to five, but may be two, three or four, or even more than six. The height h of the edged portion 2A, the radius of curvature R of the continuous curved surfaces, and the diameter d of the tip end or the angle of cone $\alpha$ are such as to reduce the liquid stream to a thin film and dam the liquid flow.

With such construction, the edged portion 2A of the vibrating element is free of recesses or wells where a pool of liquid may be held, whereby it provides for very good spray "drainability". Furthermore, the vibrating element according to this invention has also the advantage that since the multi-stepped edges are defined by connecting curved surfaces in series, the effective vibrating surface area is increased to thereby provide an increased capacity for atomizing liquid.

The vibrating element according to the teaching of this invention is not limited to the configuration as illustrated in FIG. 1 but may be embodied in various forms as shown in FIGS. 2 to 5, for example.

Figure 2:
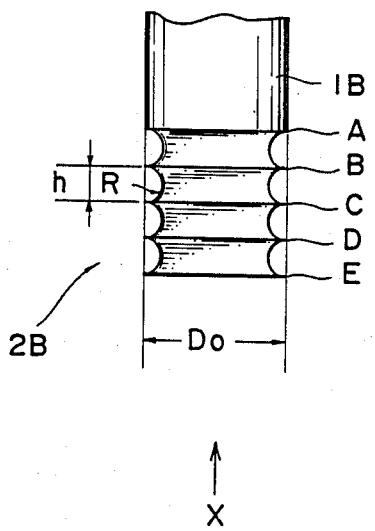

The vibrating element 1B shown in FIG. 2 has an edged portion 2B comprising one or more annular steps (five steps in the embodiment of FIG. 2) having an equal diameter. The shape of the edged portion 2B as viewed in the direction indicated by the arrow X is not limited to a circle but may be triangular, square or any other polygonal shape.

Figure 3:
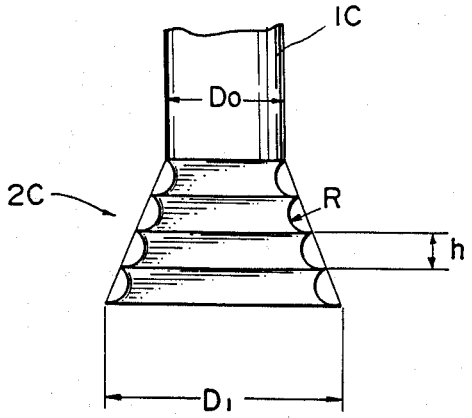

FIG. 3 illustrates an alternate form of the vibrating element according to this invention. The vibrating element 1C in this embodiment has an edged portion 2C comprising annular concentric steps having progressively increased diameters, as opposed to the vibrating element 1A of FIG. 1.

Figure 4:
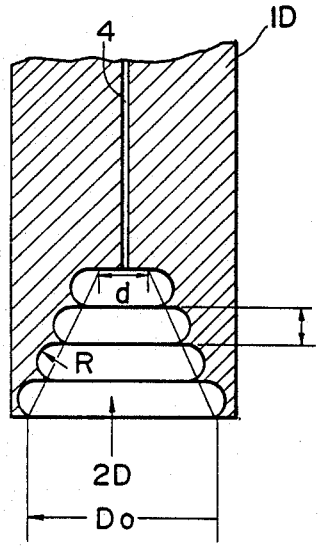
FIGS. 4 and 5 are fragmentary cross-sectional views of alternate embodiments of the ultrasonic atomizing vibratory element according to the present invention.
Figure 5:
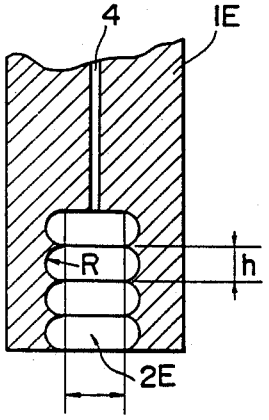

FIGS. 4 and 5 illustrate vibrating elements 1D and 1E according to still other embodiments of this invention in which the multi-stepped edged portion comprises one or more steps formed around the inner periphery of the lower end portion of the element. In these embodiments it is to be noted that the edged portions 2D and 2E are supplied with liquid through liquid supply passages 4 formed through the vibrating elements 1D and 1E.

In the embodiments described above, the multi-stepped edged portion is formed by connecting continuous curved surfaces in series. However, taking the embodiment of FIG. 1 for example, the continuous curved surfaces R1, R2, R3, R4 need not necessarily have the same radius of curvature, but may be defined by connecting curved lines of different radii of curvature or by a succession of curved and straight lines.

Figure 8:
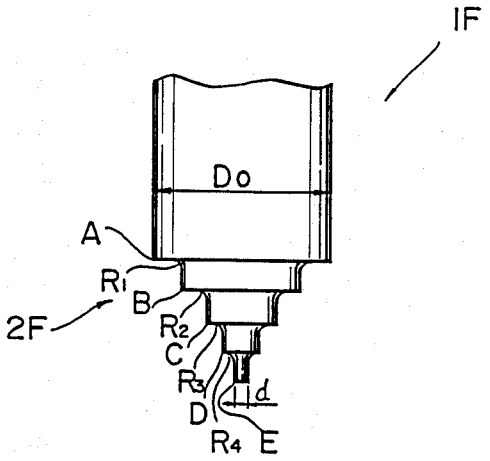
FIG. 8 is a fragmentary cross-sectional view of an alternate embodiment of the ultrasonic atomizing vibratory element according to the present invention.

One example of such embodiment is a vibrating element 1F illustrated in FIG. 8 in which the recesses between adjacent edges A, B, C, D and E are formed by continuous curved surfaces R1, R2, R3, and R4, each surface defined by a succession of curved and straight lines, as in the vibrating element 1A of FIG. 1 in which the recesses between the edges are defined by concave surfaces R1, R2, R3 and R4.

In summary, of most importance to the present invention is it that a liquid path extending between adjacent edges be free of any step or recess in which a pool of liquid may be held.

An actual example of various parameters and dimensions applicable to the ultrasonic injection atomizing apparatus according to this invention is as follows: It has been found that such apparatus is capable of providing a large capacity for atomization.

| | |
|---|---|
| Output of ultrasonic vibration generating means: | 10 watts |
| Amplitude of vibrating element: | 34 μm |
| Frequency of vibration: | 38 KHz |

-continued

| | |
|---|---|
| Geometry of vibrating element (shown in FIG. 1) | |
| Diameter and radius of curvature R of edged portion | |
| First step: | Diameter Do 7 mm |
| Second step: | R. 0.5 mm |
| Third step: | R. 0.5 mm |
| Fourth step: | R. 0.5 mm |
| Fifth step: | R. 0.5 mm |
| Height h of each step: | 2 mm |
| Type of fuel: | Gas oil |
| Flow rate of fuel: | ~0.06 $cm^2$ per injection |
| Injection pressure: | 1-70 $kg/cm^2$ |
| Temperature of fuel: | Normal temperature |
| Material for vibrating element: | Titanium |

Effects of the Invention

As explained hereinabove, it is to be appreciated that the ultrasonic atomizing vibratory element having a unique configuration according to this invention provides greatly improved spray "drainability" and an increase in the effective vibrating surface area, hence an increase in the capacity for atomization, and further provides stable atomization with no substantial changes in the atomization conditions such as flow rate and particle size depending on the properties, particularly the viscosity of supply liquid.

We claim:

1. A vibrating element for ultrasonic atomization having a multi-stepped edged portion formed around a periphery of the element, said multi-stepped edged portion being adapted to be supplied with a liquid from a single liquid source, said multi-stepped edged portion having at least two steps, each said step defining an edge, each said edge severing and atomizing said liquid as said liquid serially flows from one said step to said next step, said edges being interconnected by a curved surface.

2. The vibrating element according to claim 1 wherein said curved surface being a continuously curved surface.

3. A vibrating element for ultrasonic atomization having a multi-stepped edged portion formed around an inner periphery of the element, said multi-stepped edged portion being adapted to be supplied with a liquid from a single liquid source, said multi-stepped edged portion having at least two steps, each said step defining an edge, each said edge severing and atomizing said liquid as said liquid serially flows from one said step to said next step, said edges being interconnected by a curved surface.

4. The vibrating element according to claim 3 wherein said curved surface being a continuously curved surface.

5. A vibrating element for ultrasonic atomization using multi-stepped edged portion formed around an outer periphery of the element, said multi-stepped edged portion being adapted to be supplied with a liquid from a single liquid source, said multi-stepped edged portion having at least two steps, each said step defining an edge, each said edge severing and atomizing said liquid as said liquid serially flows from one said step to said next step, said edges being interconnected by a curved surface.

6. The vibrating element according to claim 5 wherein said curve surface being a continuously curved surface.

* * * * *